US005251569A

United States Patent [19]

Seron

[11] Patent Number: 5,251,569

[45] Date of Patent: Oct. 12, 1993

[54] MULTIPLE TONE WHISTLE

[75] Inventor: Suren V. Seron, Platville, Ill.

[73] Assignee: Seron Manufacturing Co., Joliet, Ill.

[21] Appl. No.: 787,375

[22] Filed: Nov. 4, 1991

[51] Int. Cl.[5] ..... G10K 5/00

[52] U.S. Cl. ..... 116/137 R; 116/141; 446/206

[58] Field of Search ..... 116/137 R, 140, 141; 84/330, 378; 446/204, 206, 208, 216

[56] References Cited

U.S. PATENT DOCUMENTS

| | | | |
|---|---|---|---|
| D. 263,383 | 3/1982 | Moore | D10/119 |
| D. 279,461 | 7/1985 | Lafreniere | D10/119 |
| 632,184 | 8/1899 | Johnson . | |
| 696,814 | 4/1902 | Hatch . | |
| 1,814,730 | 7/1931 | Myers . | |
| 1,852,934 | 4/1932 | Michalski . | |
| 2,052,926 | 9/1936 | Frisk | 84/330 |
| 2,113,396 | 4/1938 | Butterfield | 116/137 R |
| 2,454,105 | 11/1948 | Thompson | 446/206 |
| 2,777,251 | 1/1957 | Bailey . | |
| 4,207,703 | 6/1980 | Saso . | |
| 4,359,961 | 11/1982 | Seron | 116/137 R |
| 4,709,651 | 12/1987 | Lance | 116/137 R |
| 4,821,670 | 4/1989 | Foxcroft | 116/137 R |
| 5,086,726 | 2/1992 | Sharp | 116/137 R |

FOREIGN PATENT DOCUMENTS

| | | | |
|---|---|---|---|
| 4821670 | 11/1990 | Canada | 116/137 R |
| 1309168 | 10/1962 | France | 116/137 R |
| 553AD1909 | of 1909 | United Kingdom . | |
| 20AD1915 | 1/1916 | United Kingdom . | |
| 0116329 | 12/1942 | United Kingdom . | |

*Primary Examiner*—William A. Cuchlinski, Jr.
*Assistant Examiner*—W. Morris Worth
*Attorney, Agent, or Firm*—Wood, Phillips, VanSanten, Hoffman & Ertel

[57] ABSTRACT

A whistle having a whistle body (10) including two distinct resonating chambers (20), each with an opening (34) to the exterior of the whistle body (10) and a mouthpiece (14) in fluid communication with both of the chambers (20). At least one of the chambers (20) is provided with at least one additional opening (36) to the interior thereof.

14 Claims, 1 Drawing Sheet

MULTIPLE TONE WHISTLE

FIELD OF THE INVENTION

This invention relates to whistles.

BACKGROUND OF THE INVENTION

Recent years have seen an upsurge in the popularity of fixed tone whistles. In the usual case, two or more sound chambers of different lengths are connected to a common mouthpiece. When a person blows through the mouthpiece, two or more different pitches, each proportional to the length of its associated sound chamber, are generated. These pitches, taken together, provide a sound of a particular perceived quality which is the tone of the whistle. Because this tone cannot be varied because the pitches of the sounds generated in the various chambers cannot be changed, the whistle tone is fixed.

In a number of cases, the chambers are so designed so that the pitches are dissonant and at frequencies such that a fairly rapid "beat" arises as the frequencies alternately reinforce and negate each other. In some cases, the chamber design is so chosen to provide three pitches whose "beat" approximates the oscillation of a mechanical armature such as a cork ball in a typical whistle. Two such constructions are known in the prior art and each employs three chambers, each of a different length. These constructions eliminate the need for such an armature as well as the problems that may accompany the use of a whistle with an armature, such as freeze up in cold weather.

While successful to this degree, fixed tone whistles are not without their disadvantages. For one, the dissonance produced by the different pitches may be overly unpleasing to certain listeners. Secondly, the "beat" cannot be altered as it is a function of chamber fabrication.

Thirdly, because the pitch difference is typically based on a difference in length in the chambers, fixed tone whistles frequently are relatively long and may be unwieldy in comparison to the conventional armature equipped whistle commonly employed in athletic contests today.

Furthermore, such whistles may be difficult to fabricate, requiring complex molding techniques or the use of assembly techniques that include the installation of a partition in a barrel, an insert or the like coupled with a need to mount and seal various components or else the desired tonal effect may not be achieved.

The present invention is directed to overcoming one or more of the above problems.

SUMMARY OF THE INVENTION

It is the principal object of the invention to provide a new and improved whistle. More specifically, it is an object of the invention to provide a new and improved multiple tone whistle, a new and improved whistle that lends itself to easy manufacturing techniques, and a new and improved whistle whose pitches may be readily altered.

According to one facet of the invention, in a whistle having a whistle body including two distinct resonating chambers, each with an opening to the exterior of the whistle body, and a mouth piece in fluid communication with both the chambers, the invention contemplates the improvement where at least one of the chambers is provided with at least one additional opening to the exterior.

In a preferred embodiment of the invention, there is at least one knock out in the body to at least one of the chambers and which may be removed to create the additional opening.

In a highly preferred embodiment, there are several such knockouts to each chamber so that a number of different frequencies corresponding in number to the number of knockouts may be selectively chosen.

A highly preferred embodiment of the invention contemplates that the body of the whistle be made of plastic material and that the knockouts comprise a relatively thin area in the wall of one of the chambers which is surrounded by a relatively thick peripheral area in the wall thereat.

Preferably, the knockout is defined by a recess in the wall of one of the chambers and even more preferably, the recess is in an exterior surface of such wall.

According to another facet of the invention, there is provided a plastic whistle construction including an elongated whistle body having a mouth piece end and an opposite, resonating chamber end. The body is molded of plastic material and has a nominally central longitudinal partition. Two enlarged recesses are located in the resonating end, one on each side of the petition. A channel extends from each recess on the associated side of the partition to the mouthpiece end and opens to the exterior thereof. Two openings are located in the resonating chamber end, each extending to an associated one of the recesses and first and second caps are mounted on opposite sides of the body and the partition and close the adjacent recess and associated channel.

In a preferred embodiment, the sides of the body include grooves and the caps include ribs received in the grooves. The ribs and grooves carry mating snap-fit formations to hold the ribs in the grooves at least during assembly of the whistle.

According to another facet of the invention, there is provided a plastic whistle comprising a main whistle body including an elongated throat with opposed parts and terminating at one end at a mouthpiece opening and at its other end in a sound chamber. The throat and the chamber are open along a common side of the body and an orifice is disposed in the body to open to the chamber. The orifice is in a side of the body adjacent the common side and extends thereto. At least one groove is located in the common side of the body and a closure is provided for the common side which has a peripheral size and shape substantially the same as the periphery of the common side The closure has a side in abutment with the body and such side has a rib disposed in each such groove in the body. The grooves and the ribs have mating snap-fit formations for holding the closure side in abutment with the body at least during assembly of the closure to the body.

Preferably, the ribs terminate in a relatively sharp apex to promote the formation of a sealed, ultrasonic weld between the body and the closure. In this embodiment, the snap-fit formations on the ribs are located between the apex and the closure.

Preferably, the snap-fit formation is hook-like in cross section.

According to another facet of the invention, there is provided a variable pitch whistle which includes a whistle body having a resonating chambers, a mouthpiece channel extending to the chamber, and an orifice in the body extending from the chamber to the exterior of the body. A plurality of knockouts are disposed in the body adjacent the chamber and are removable to create one or more additional openings from the exterior of the body to the chamber.

Other objects and advantages will become apparent from the following specification taken in connection with the accompanying drawings.

DESCRIPTION OF THE PREFERRED EMBODIMENT

Figure 1:
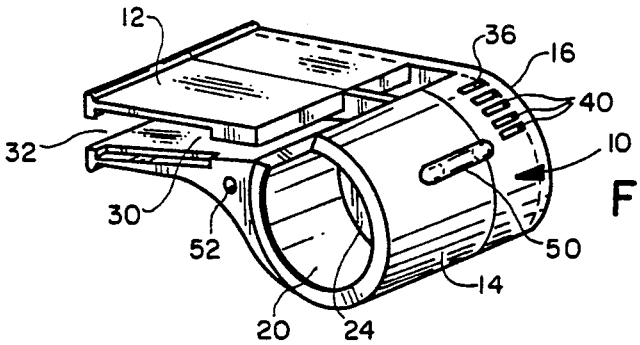
FIG. 1 is a perspective view of a partially assembled, multiple tone whistle made according to the invention.

An exemplary embodiment of the invention is illustrated in the drawings and will be described herein as a multiple tone whistle of the type lacking a movable armature within the sound or resonating chamber. However, it is to be expressly understood that certain features of the invention may be employed advantageously in single tone whistles and that the use of a movable armature such as conventional cork ball or the like is strictly up to the user or manufacturer. Thus, except to the extent expressly claimed, no limitation to a multiple tone whistle or a whistle lacking an armature is to be implied.

Figure 2:
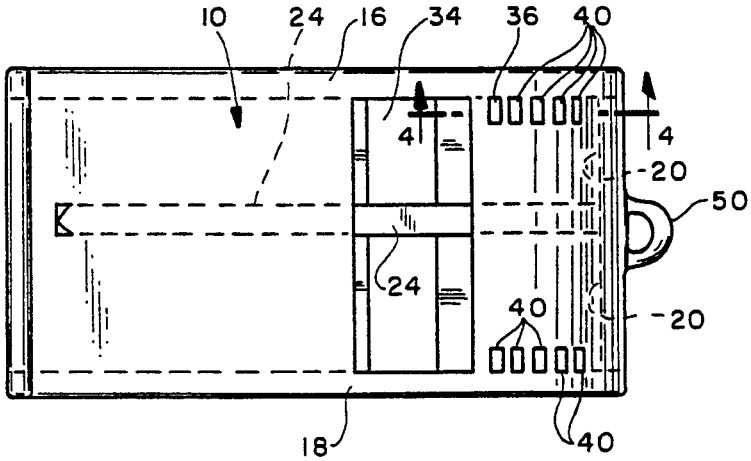
FIG. 2 is a plan view of the completely assembled whistle.

With reference to FIGS. 1 and 2, a whistle made according to the invention, includes a whistle body, generally designated 10, made of any suitable thermoplastic. The body 10 includes a mouthpiece end 12 as well as a sound or resonating chamber end 14.

Side caps or closures 16 and 18 flank the body 10 on both sides thereof and become part thereof when secured thereto as seen in FIG. 2. In this respect, FIG. 1 illustrates the whistle with only the closure 16 in place.

Figure 3:
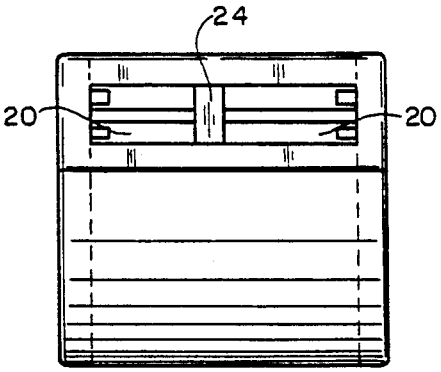
FIG. 3 is a side elevation of the whistle.

Within the sound chamber end 14 of the whistle, there are a pair of sound or resonating chambers 20, only one of which is shown in FIG. 1. The two chambers 20 are separated from one another by a longitudinal partition 24 within the body 10 As seen in FIGS. 2 and 3, the partition 24 is nominally centered within the body 10. By "nominally centered" it is meant that the partition 24 is located between the closures 16 and 18 and spaced from each. By choosing a partition location other than the precise center of the body 10, the two chambers may have different widths. This difference will alter the tone quality (as opposed to the frequency) of the sound generated in each chamber 20.

The mouthpiece end 12 includes a channel 30 which extends from the chambers 20 to a mouthpiece opening 32. The partition 24 separates the channel 30 into two sections, each in fluid communication with the respective one of the two chambers 20. Preferably, the body is of one piece construction with the recesses 20 and channels 30 molded therein in opposite sides of the partition 24.

The whistle also includes an opening or aperture of conventional configuration that extends from the exterior of the body 10 to the interior chambers 20. The aperture is illustrated at 34 and is divided into two sections by the partition 24. Thus, there are in effect two apertures, one for each of the chambers 20.

Figure 4:
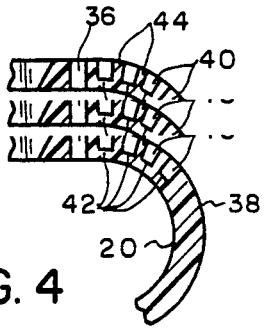
FIG. 4 is a fragmentary sectional view taken approximately along the line 4—4 in FIG. 2.

According to the invention, at least one of the chambers 20 is provided with an additional aperture opening which will have the effect of changing its pitch or frequency. One such additional opening is seen at 36 in FIGS. 1, 2 and 4. In a highly preferred embodiment, there is the potential for providing a plurality of such openings 36. Specifically, the exterior surface 38 of the body 10 adjacent the chambers 20 is provided with a series of recesses 40. As a consequence of this, the bottoms 42 of the recesses 40 are a relatively thin section of the wall defining the chamber 20 which may be easily broken by a sharp instrument or even a ballpoint pen. The bottoms 42 thus serve as knockouts that may be easily removed to provide additional ones of the openings 36 to the interior of the associated chamber 20.

The recesses 40 may be employed with one or both of the chambers 20 as desired and may be located in the associated cap 16 or 18 as desired. In the usual case, the whistle will be sold with one opening 36 already present. This can be accomplished by molding the whistle with a hole already in place or by knocking out the bottom 42 of one of the recesses 40 prior to sale.

It will be appreciated that at locations between the recesses 40, there is a full wall thickness as shown at 44. Thus, the bottoms 42 or weakened areas, are surrounded peripherally by a relatively thick peripheral section.

In the usual case, where the chambers 20 and apertures 34 have the same geometry, a single frequency will be generated on both sides of the partition 24. To alter the frequency or pitch of the sound produced in one of the chambers 20, a sharp instrument is applied to the recesses 40 to knock out one or more of the bottoms 42. With the knock out of each bottom 42, an increase in the frequency generated within the associated chamber 20 will occur. The process may be repeated until the desired pitch difference is achieved.

It will be noted that the whistle illustrated in FIG. 1 as an exemplary embodiment of the invention is configured in the familiar form of a conventional athletic whistle of the type including a cork ball as an armature and thus is easily manipulated. It is provided with a mounting eye 50 on the sound chamber end 14. It is to be observed that the mounting eye 50 is rotated approximately 90° from the more conventional position for such eyes which is advantageous when connected to a conventional lanyard since the user will not have to rotate the whistle 90° while bringing the mouthpiece end 12 to the user's lips.

Figure 5:
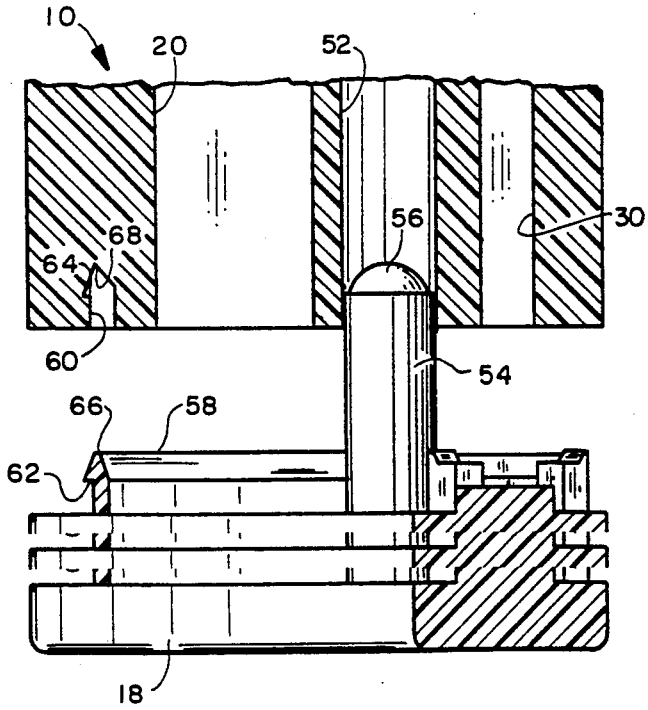
FIG. 5 is an enlarged, fragmentary view of the assembly of a cap or closure to the whistle body before complete assembly has occurred.

In general terms, the whistle of the invention may be fabricated using ultrasonic welding techniques as more fully disclosed in my earlier, commonly assigned U.S. Pat. No. 4,359,961, issued Nov. 23, 1982, the details of which are herein incorporated by reference. To this end, each side of the whistle body 10 includes a pilot hole 52, for receiving a post 54 (FIG. 5) which enters the pilot hole 52 to serve to properly align the corresponding end cap or closure 16, 18 with the whistle body 10. Each of the posts 54 includes a semi-spherical end 56 which is useful for ensuring a good ultrasonic weld. In addition, each of the caps 16, 18, includes a rib 58 which is intended to enter an aligned groove 60 on the associated side of the whistle body 10. As can be seen, in cross section, each rib 58 is somewhat hook like having a hook formation 62 which is adapted to overlap a ledge 64 within the groove 60. These formations form mating snap-fit formations whose principal purpose is to hold the corresponding cap 16 or 18 to the body 10 during assembly, that is, until ultrasonic welds can secure the components together.

Preferably, the ribs 58 are provided with a relatively sharp apex 66 which bottoms out against the bottom 68 of the groove 60. When ultrasonic welding is applied, the bottoming out of the apex 66 against the bottom of the groove 68 assures that a good ultrasonic weld is obtained and one which will be fully sealed about the length of the ribs 58 to prevent leakage during use of the whistle.

From the foregoing, it will be appreciated that the invention provides a multiple tone whistle of conventional size and which may be easily used in a conventional way. The use of the knockouts allow the user to selectively vary the pitch of one or both of the sound chambers 20 to attain any desired pitch difference or beat frequency as desired. The unique body with the nominally central partition with recesses on opposite sides which define the resonating or sound chambers provides a simple, yet reliable means of fabricating a multiple tone whistle when used in connection with closures such as the closures 16, 18, thus, it will be appreciated that a number of the difficulties associated with prior art whistles are overcome by the invention.

Furthermore, by making the respective chambers 20 of differing widths by nominally, but not perfectly, centering the partition 24, both chambers of a single whistle will produce different tonal qualities which, when coupled with pitch differences, can accentuate the beat frequency to closely simulate that of a conventional whistle containing a cork armature.

Importantly, the present invention achieves the generation of a beat frequency like that of a conventional whistle having a cork armature using only two chambers instead of three and allows the user to adjust the frequency or pitch generated by at least one of the chambers to attain the effect desired by that particular user.

I claim:

1. In a whistle having a whistle body including two distinct resonating chambers, each with an opening to the exterior of the whistle body, and a mouthpiece in fluid communication with both said chambers, the improvement including at least one knockout in said body to at least one of said chambers that may be removed to create at least one additional pitch altering opening in said at least one of said chambers.

2. The whistle of claim 1 wherein said body is made of plastic material and said at least one knockout and comprises a relatively thin area in a wall of said at least one of said chambers and surrounded by a relatively thick peripheral area in the wall of said at least one of said chambers.

3. The whistle of claim 2 wherein said at least one knockout is defined by a recess in the wall of said at least one of said chambers.

4. The whistle of claim 3 wherein said recess is in an exterior surface of said wall.

5. The whistle of claim 4 wherein there are plural recesses in spaced relation to each other.

6. A plastic whistle construction including an elongated whistle body having a mouthpiece end and an opposite, resonating chamber end;

said body being molded of plastic material and having a nominally central longitudinal partition;

two enlarged recesses molded in said resonating end, one on each side of said partition;

a channel extending from each recess on an associated side of said partition to said mouthpiece end and opening exteriorly thereof;

two openings in said resonating chamber end, each extending to an associated one of said recesses; and first and second caps mounted on opposite sides of said body closing an adjacent recess and associated channel to form a pair of resonating chambers at said resonating end.

7. The whistle of claim 6 wherein there is at least one additional opening in said resonating chamber end extending to at least one of said recesses.

8. The whistle of claim 6 wherein said resonating chamber end includes at least one knock out removable to create an additional opening to one of said recesses for selectively varying the pitch of one of said resonating chambers.

9. The whistle of claim 6 wherein said opposite sides of said body include grooves and said caps include ribs received in said grooves, said ribs and grooves carrying mating snap-fit formations to hold said ribs in said grooves at least during assembly of said whistle.

10. The whistle of claim 9 wherein said ribs have noses to promote sealed ultrasonic welds of said ribs to said body within said grooves.

11. A plastic whistle comprising a main whistle body including an elongated throat terminating at one end in a mouthpiece opening and at its other end in an enlarged sound chamber, said throat and said chamber being open along a common side of said body;

an orifice in said body opening to said chamber, said orifice being in a side of said body adjacent said common side and extending thereto;

at least one groove in said common side of said body;

a closure for said common side having a peripheral size and shape substantially the same as the periphery of said common side, said closure having a side in abutment with said body; said closure side having a rib disposed in at least one groove;

said at least one groove and said rib having mating snap-fit formations for holding said closure side in abutment with said body at least during assembly of said closure to said body.

12. The whistle of claim 11 wherein said rib terminates in a relatively sharp apex to promote the formation of a sealed ultrasonic weld between said body and said closure, said snap-fit formation on said rib being located between said apex and said closure.

13. The whistle of claim 12 wherein said snap-fit formation is hook-like in cross section.

14. A whistle including a main whistle body having a mouthpiece end and an opposite, sound chamber end; a sound chamber within said sound chamber end; a channel within said body extending from said chamber to said mouthpiece end for receipt of air under pressure; an orifice in said body opening to said chamber; and a plurality of knockouts in said body adapted to be removed to create one or more additional orifices opening to said chamber to selectively vary the pitch of the whistle.

* * * * *